US005901409A

United States Patent [19]

Schick et al.

[11] Patent Number: 5,901,409

[45] Date of Patent: May 11, 1999

[54] ROAD SWEEPING MACHINE

[75] Inventors: Roland Schick, Auenwald; Uwe Urban, Weinstadt; Eberhard Veit, Göppingen, all of Germany

[73] Assignee: Alfred Karcher GmbH & Co., Winnenden, Germany

[21] Appl. No.: 09/064,423

[22] Filed: Apr. 22, 1998

Related U.S. Application Data

[63] Continuation of application No. PCT/EP95/04150, Oct. 23, 1995.

[51] Int. Cl.[6] ..... E01H 1/05

[52] U.S. Cl. ..... 15/340.3; 15/340.4; 15/349

[58] Field of Search ..... 15/347, 349, 340.3, 15/340.4

[56] References Cited

U.S. PATENT DOCUMENTS

| | | | |
|---|---|---|---|
| 2,739,340 | 3/1956 | Blydenburgh et al. | 15/349 |
| 3,006,621 | 10/1961 | Patch | 15/349 X |
| 3,484,889 | 12/1969 | McCandless | 15/340.4 |
| 3,639,940 | 2/1972 | Carlson et al. | 15/349 X |
| 3,670,359 | 6/1972 | Gutbrod | 15/349 X |

FOREIGN PATENT DOCUMENTS

| | | |
|---|---|---|
| 1165589 | 10/1958 | France . |
| 2 263 224 | 7/1973 | Germany . |

*Primary Examiner*—Chris K. Moore
*Attorney, Agent, or Firm*—Barry R. Lipsitz

[57] ABSTRACT

In order that a road-sweeping machine with a chassis, with unsteered rear wheels and steered front wheels, with an engine which is disposed substantially above the rear wheels and drives them, with a seat near the engine and with a sweeping roller disposed on the underside of the chassis between the front and rear wheels at right angles to the direction of travel, and with a dirt collector, may be constructed in such a way that it has a compact construction of simple design and has a good sweeping effect whilst producing little dust, it is proposed that the dirt collector is disposed between the front and rear wheels adjacent to the sweeping roller and is connected by way of a suction line to a suction unit, and that the engine is disposed with the output shaft directed substantially vertically, the output shaft projecting upwards and downwards out of the engine, wherein the upwardly projecting portion thereof drives the suction unit and the downwardly projecting portion drives the rear wheels and the sweeping roller.

15 Claims, 1 Drawing Sheet

ROAD SWEEPING MACHINE

Figure 1:
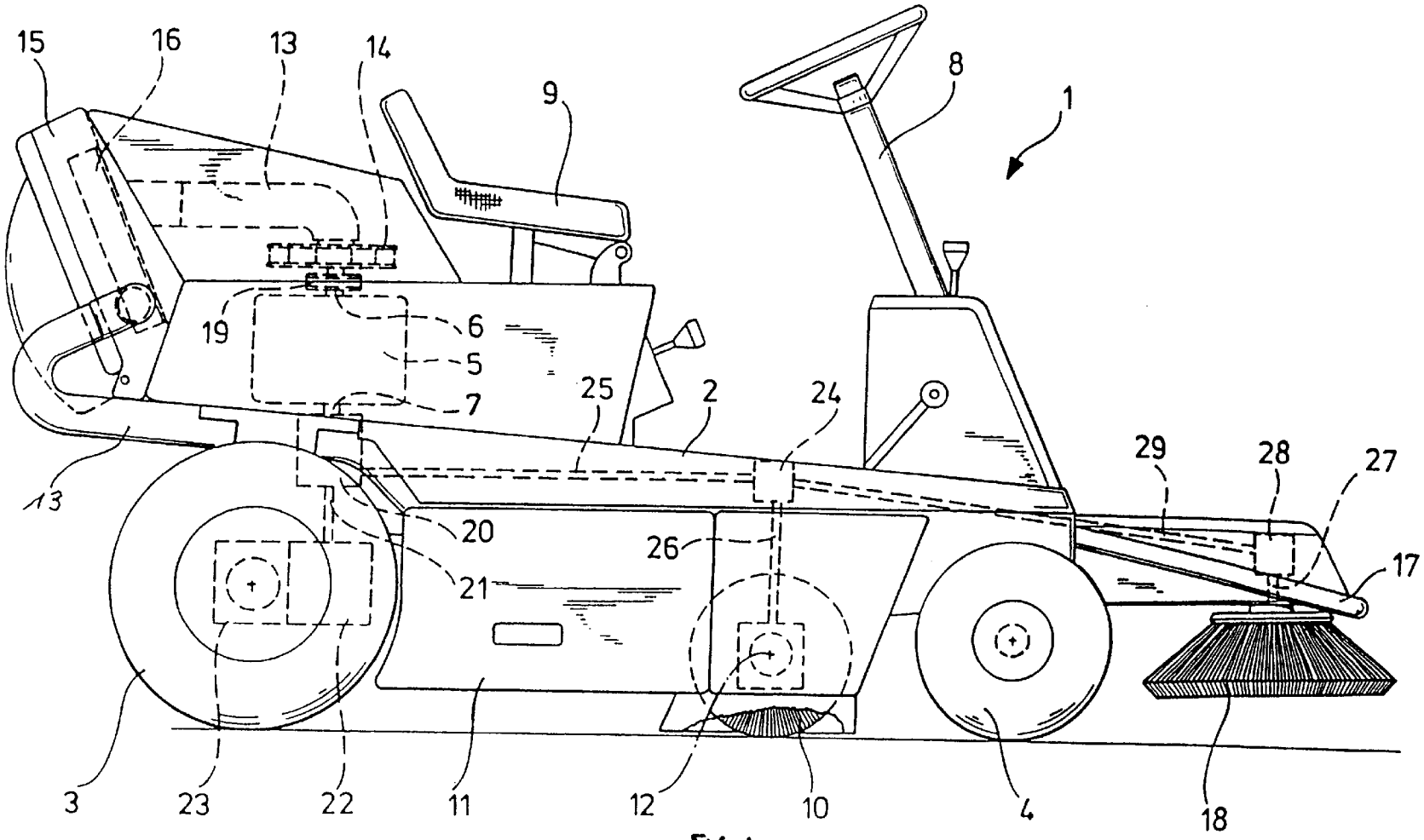

The present invention is a continuation of international application PCT/EP/04150 of Oct. 23, 1995, the entire specification of which is incorporated herein by reference.

The invention relates to a road-sweeping machine with a chassis, with unsteered rear wheels and steered front wheels, with an engine which is disposed substantially above the rear wheels and drives them, with a seat near the engine and with a sweeping roller disposed on the underside of the chassis between the front and rear wheels at right angles to the direction of travel, and with a dirt collector.

Such road-sweeping machines are used for example for cleaning streets and open spaces, wherein the surface to be cleaned is swept with the sweeping roller and the dirt is conveyed into the dirt collecting device. A road-sweeping machine is known from German Patent Document No. 22 63 224 in which the dirt is swept by two circular brushes in front of a sweeping roller which is disposed behind the circular brushes in the direction of travel, then takes up the dirt and conveys it into the dirt collector. The dirt collector is disposed between the two rear wheels and includes a pivoting device so that it can be pivoted upwards against the direction of travel and can then be emptied by way of a flap facing the rear wheels. Thus the road-sweeping machine which is known from the said German Patent Document has a costly construction which uses a large number of moving parts and is correspondingly susceptible to breakdown. The use of a total of three sweeping brushes can produce of a considerable amount of dust in the case of dry surfaces, and only some of the dust which occurs is conveyed into the dirt collector.

The object of the present invention is to design a road-sweeping machine of the above type in such a way that it has a compact construction of simple design and has a good sweeping effect whilst producing little dust.

In a road-sweeping machine of the type described in the introduction this object is achieved according to the invention in that the dirt collector is disposed between the front and rear wheels adjacent to the sweeping roller and is connected by way of a suction line to a suction unit, and that the engine is disposed with the output shaft directed substantially vertically, the output shaft projecting upwards and downwards out of the engine, wherein the upwardly projecting portion thereof drives the suction unit and the downwardly projecting portion drives the rear wheels and the sweeping roller.

In the construction according to the invention the sweeping roller and the dirt collector are disposed adjacent to one another between the front and rear wheels, resulting in a particularly compact construction. In order to reduce the production of dust during operation of the road-sweeping machine, the road-sweeping machine also has a suction unit which draws the dust into the dirt collector. In order for it to be possible to dispose the largest possible dirt collector in the confined space between the front and rear wheels, in the construction according to the invention it is provided that the suction unit is connected by way of a suction line to the dirt collector and thus can be disposed at a distance from the dirt collector. A particularly compact construction without the use of means which are costly to construct is achieved in that the engine is disposed vertically, i.e. with the output shaft directed substantially vertically and projecting both upwards and downwards out of the engine. The rear wheels and the sweeping roller which are disposed below the chassis are driven by the downwardly projecting portion of the output shaft. The suction unit, the positioning of which is independent of the position of the dirt collector because of the use of the suction line, is driven by the portion of the output shaft projecting upwards out of the engine.

It is advantageous for the suction unit to be disposed above the engine, adjacent to the upwardly projecting portion of the output shaft, since this results in a particularly compact and space-saving construction.

It is favourable if a V-belt pulley for a V-belt which drives the suction unit is held so as to be fixed against rotation on the portion of the output shaft which projects upwards out of the engine. Such a construction can be produced particularly economically, since the drive connection between the motor and the suction unit is effected by particularly simple means, namely V-belts.

It may be provided that a gear for transferring the motion of the output shaft to the rear wheels and the sweeping roller is mounted on the portion of the output shaft which projects downwards out of the engine.

The gear may for example include V-belt pulleys for V-belts which drive the rear wheels and the sweeping roller. Such an arrangement produces a space-saving construction, wherein the V-belts can also advantageously serve as coupling elements by changing their tension.

In a particularly preferred embodiment of the road-sweeping machine according to the invention it is provided that the V-belt which drives the sweeping roller engages on a V-belt pulley which is held so as to be fixed against rotation on an intermediate shaft, wherein the intermediate shaft is rotatably mounted coaxially with the axis of rotation of the sweeping roller and is operatively connected by way of gear means to the sweeping roller. By the arrangement of the intermediate shaft coaxially with the axis of rotation of the sweeping roller, the driving motion of the output shaft can be transferred without complication to the sweeping roller.

A construction which is of particularly simple design and economical to manufacture is produced in that the gear means between the intermediate shaft and the sweeping roller include a further V-belt with V-belt pulleys.

In order to be able to influence the movement of the rear wheels independently of the movement of the sweeping roller or of the suction unit, in an advantageous embodiment it is provided that the V-belt which drives the rear wheels engages on a V-belt pulley of an intermediate gear which is operatively connected to the rear wheels.

The intermediate gear can for example include a V-belt pulley with variable external diameter for regulating the speed of the road-sweeping machine. As a result it is possible with simple means to vary the speed of the rear wheels with a constant speed of the output shaft of the engine.

It is advantageous if a brush which rotates about a substantially vertical axis of rotation is disposed on the chassis in front of the front wheels and is driven by the portion of the output shaft which projects downwards out of the engine by way of gear means. With the aid of the additional brush it is also possible to clean corners and edges which are not accessible with the sweeping roller disposed between the front wheels and the rear wheels. In this case no separate drive is necessary for the additional brush, but rather the brush is driven for example by way of additional V-belt pulleys and V-belts by the portion of the output shaft which projects downwards out of the engine.

In a particularly preferred embodiment there is connected into the suction line a fine dirt collector containing a filter through which the air stream passing through the fine dirt collector flows. In this way complete cleaning of the air stream which is drawn in is achieved, the particles of dirt which are removed being collected in the fine dirt collector.

In an advantageous embodiment the fine dirt collector can be disposed behind the engine in the direction of travel. This results in particularly good accessibility of the fine dirt collector and of the filter contained therein.

The following description of a preferred embodiment of the invention serves in combination with the drawing for more detailed explanation.

The drawing shows the road-sweeping machine 1 which includes a chassis 2 with two unsteered rear wheels 3 and two steered front wheels 4. Above the rear wheels 3 is disposed an engine 5, the output shaft of which is vertically aligned, an upper portion 6 of the output shaft projecting upwards out of the engine 5 whilst a lower portion 7 of the output shaft projects downwards out of the engine 5. A steering system 8 is disposed above the front wheels 4, and a seat 9 is positioned between the engine 5 and the steering system 8.

Between the front wheels 4 and the rear wheels 3, below the chassis 2, are disposed a sweeping roller 10 and, immediately adjacent thereto, a dirt collector 11. The axis of rotation 12 of the sweeping roller is aligned at right angles to the longitudinal direction of the road-sweeping machine 1 and thus also at right angles to the direction of travel thereof.

The dirt collector 11 is connected by way of a suction line 13 to a suction turbine 14 mounted above the engine 5, wherein a fine dirt collector 15 which is disposed behind the engine 5 at the rear of the roadsweeping machine 1 in the direction of travel contains a filter 16 is connected into the suction line. The filter may be constructed for example as a pleated filter. The suction line 13 extends parallel to the long side of the chassis 2 and enters the lower region of the fine dirt collector 15 facing the rear wheels and leaves it again through the upper surface facing the engine 5.

A circular brush 18 which is rotatable about an axis of rotation which extends substantially vertically is disposed in front of the front wheels 4 on the road-sweeping machine 1 by way of a retaining yoke 17.

The suction turbine 14 is driven by the upper portion 6 of the output shaft. For this a V-belt pulley 19 is mounted so as to be fixed against rotation on the upper portion 6, so that the rotary movement of the upper portion 6 of the output shaft can be transferred to the suction turbine 14 by way of the V-belt pulley 19 and a V-belt which is not shown in the drawing.

The sweeping roller 10, the rear wheels 3 and the circular brush 18 are driven jointly by the lower portion 7 of the output shaft. A gear 20, which is shown schematically in the drawing and includes V-belt pulleys which are not shown in the drawing, is mounted on the lower portion of the output shaft. The motion of the lower portion 7 of the output shaft is transferred by the gear 20 by way of a V-belt 21 and an intermediate gear 22 which is shown schematically in the drawing and which transfers the motion of the driven shaft to the rear wheels 3 by way of gear means which are also shown schematically in the drawing.

An intermediate shaft 24 which is shown schematically in the drawing is rotatably mounted on the chassis 2 above the sweeping roller 10. V-belt pulleys which are not shown in the drawing are mounted so as to be fixed against rotation on this intermediate shaft 24, so that the latter is connected to the gear 20 by way of a V-belt which extends substantially horizontally and to the sweeping roller 10 by way of a V-belt 26 which is aligned substantially vertically.

Also the circular brush 18 which is disposed in front of the front wheels 4 is driven by the lower portion 7 of the output shaft. For this a drive shaft 27 which projects out of the top of the circular brush 18 is connected to a mitre gear 28 which for its part is connected by way of a V-belt 29 to the intermediate shaft 24.

During the operation of the road-sweeping machine 1 particles of dirt are conveyed into the dirt collector 11 which is disposed behind the sweeping roller 10 in the direction of travel with the aid of the sweeping roller 10 and because of the air flow brought about by the suction turbine 14. Smaller pieces of dirt are passed with the air stream through the suction line 13 into the fine dirt collector 15. The air stream is then cleaned by the filter 16, and the pieces of dirt which are removed are collected in the fine dirt collector 15. The arrangement of the engine 5 in such a way that the output shaft is aligned vertically and the suction turbine 14 is driven by way of the upper portion 6, whilst both the rear wheels 3 and the sweeping roller 10 and the circular brush 18 are driven by the lower portion 7 of the output shaft, produces a particularly space-saving and compact construction which is economical to produce and nevertheless combines a good sweeping effect with little production of dust.

We claim:

1. Road-sweeping machine with a chassis, with unsteered rear wheels and steered front wheels, with an engine which is disposed substantially above the rear wheels and drives them, with a seat near the engine and with a sweeping roller disposed on the underside of the chassis between the front and rear wheels at right angles to the direction of travel, and with a dirt collecting device, characterised in that the dirt collector is disposed between the front and rear wheels adjacent to the sweeping roller and is connected by way of a suction line to a suction unit, and that the engine is disposed with the output shaft directed substantially vertically, the output shaft projecting upwards and downwards out of the engine, wherein the upwardly projecting portion thereof drives the suction unit and the downwardly projecting portion drives the rear wheels and the sweeping roller.

2. Road-sweeping machine as claimed in claim 1, characterised in that the suction unit is disposed above the engine, adjacent to the upwardly projecting portion of the output shaft.

3. Road-sweeping machine as claimed in claim 1, characterised in that a V-belt pulley for a V-belt which drives the suction unit is held so as to be fixed against rotation on the portion of the output shaft which projects upwards out of the engine.

4. Road-sweeping machine as claimed in claim 2, characterised in that a V-belt pulley for a V-belt which drives the suction unit is held so as to be fixed against rotation on the portion of the output shaft which projects upwards out of the engine.

5. Road-sweeping machine as claimed in claim 1, characterised in that a gear for transferring the motion of the output shaft to the rear wheels and the sweeping roller is mounted on the portion of the output shaft which projects downwards out of the engine.

6. Road-sweeping machine as claimed in claim 2, characterised in that a gear for transferring the motion of the output shaft to the rear wheels and the sweeping roller is mounted on the portion of the output shaft which projects downwards out of the engine.

7. Road-sweeping machine as claimed in claim 3, characterised in that a gear for transferring the motion of the output shaft to the rear wheels and the sweeping roller is mounted on the portion of the output shaft which projects downwards out of the engine.

8. Road-sweeping machine as claimed in claim 1, characterised in that the gear includes V-belt pulleys for V-belts which drive the rear wheels and the sweeping roller .

9. Road-sweeping machine as claimed in claim 8, characterised in that the V-belt which drives the sweeping roller engages on a V-belt pulley which is mounted so as to be fixed against rotation on an intermediate shaft, wherein the intermediate shaft is rotatably mounted coaxially with the axis of rotation of the sweeping roller and is operatively connected by way of gear means to the sweeping roller .

10. Road-sweeping machine as claimed in claim 9, characterised in that the gear means between the intermediate shaft and the sweeping roller include a further V-belt with V-belt pulleys.

11. Road-sweeping machine as claimed in claim 8, characterised in that the V-belt which drives the rear wheels engages on a V-belt pulley of an intermediate gear which is operatively connected to the rear wheels.

12. Road-sweeping machine as claimed in claim 11, characterised in that the intermediate gear includes a V-belt pulley with variable external diameter for regulating the speed of the road-sweeping machine.

13. Road-sweeping machine as claimed in claim 1, characterised in that a brush which rotates about a substantially vertical axis of rotation is disposed on the chassis in front of the front wheels and is driven by the portion of the output shaft which projects downwards out of the engine by way of gear means.

14. Road-sweeping machine as claimed in claim 1, characterised in that there is connected into the suction line a fine dirt collector containing a filter through which the air stream passing through the fine dirt collector flows.

15. Road-sweeping machine as claimed in claim 14, characterised in that the fine dirt collector is disposed behind the engine in the direction of travel.

* * * * *